US005836318A

United States Patent [19]

Adams

[11] Patent Number: 5,836,318

[45] Date of Patent: Nov. 17, 1998

[54] PIERCING DEVICE FOR CIGARS

[76] Inventor: James C. Adams, 845 S. Winton Rd., Rochester, N.Y. 14618

[21] Appl. No.: 3,431

[22] Filed: Jan. 6, 1998

[51] Int. Cl.[6] ..... A24F 13/24; A24C 1/38; A24C 5/60

[52] U.S. Cl. ..... 131/253; 131/254; 131/255; 131/281

[58] Field of Search ..... 131/253, 254, 131/255, 281

[56] References Cited

U.S. PATENT DOCUMENTS

| | | | |
|---|---|---|---|
| 317,247 | 5/1885 | Tuecke | 131/254 |
| 324,936 | 8/1885 | Heed et al. | 131/254 |
| 367,800 | 8/1887 | Fairchild | 131/254 |
| 925,158 | 6/1909 | Cragg | 131/254 |
| 933,250 | 9/1909 | Holmes | 131/254 |
| 1,092,172 | 4/1914 | Rosenberg | 131/253 |
| 1,177,852 | 4/1916 | Flanders | 131/254 |
| 1,501,811 | 7/1924 | Schley | 131/254 |
| 1,911,271 | 5/1933 | Englen | 131/254 |
| 1,916,774 | 7/1933 | Somerville | 131/254 |
| 2,312,577 | 3/1943 | Niemczynski et al. | 131/254 |
| 3,250,279 | 5/1966 | Risk | 131/254 |
| 4,733,674 | 3/1988 | Sielck et al. | 131/254 |
| 5,678,574 | 10/1997 | Huang et al. | 131/253 |

*Primary Examiner*—Stanley S. Silverman
*Assistant Examiner*—Jacqueline A. Ruller
*Attorney, Agent, or Firm*—Wall Marjama Bilinski & Burr

[57] ABSTRACT

A cigar piercing device which includes an outer housing and a moveable top receiving and indexing station for positioning the tip of a cigar. The indexing station is adapted to automatically activate a rotating piercing tool in response to the downward movement of the indexing station by downward pressure being placed against the station by the tip of the cigar.

6 Claims, 5 Drawing Sheets

PIERCING DEVICE FOR CIGARS

FIELD OF THE INVENTION

This invention relates in general to a piercing device, and more specifically for a device for piercing or perforating the end of a cigar.

BACKGROUND OF THE INVENTION

In order to permit to a cigar to draw properly when smoked, it is common that the smoking end of the cigar be either perforated or cut off to facilitate a proper draw. This is accomplished in the art by a wide variety of implements and devices, some of which are extremely complex and cumbersome.

U.S. Pat. No. 1,092,172 is directed to a device for cigar bunch slitting and includes a plurality of cutting knives which slit or cut the end of the cigar.

U.S. Pat. No. 1,501,811 is directed to a cigar perforating device which utilizes a drill actuated by a series of mechanical means and gears.

U.S. Pat. No. 2,277,686 is directed to an apparatus for perforating and cleaning a plurality of cigars in an assembly line fashion and is directed to a complex apparatus in conjunction with conveyor means and other supporting complex hardware driven by a multiple gearing arrangement.

U.S. Pat. No. 1,911,271 is directed to a boring device for cigars. This device is not automatic and therefore requires the use of both hands for operation. A boring tool driven by a motor bores the hole in the end of the cigar which comes into contact with the end of a boring tool through a plunger which overcomes a spring in its downward direction. A separate switch, which is operated by a finger piece, is used to manually control the operation of the motor during the boring action. The device requires two hands to operate it does not include any safety measures with respect to the electrical circuitry.

U.S. Pat. No. 2,312,577 is directed to a cigar piercing apparatus which operates in a horizontal plane in order to prevent axial displacement of the cutter during the piercing operation. The main inventive feature appears to be the construction of the piercer to remove the cuttings through a hollow bore which operates in conjunction with an internal storage container.

Considering the complexity of the prior art devices described above, it can be seen that there is a need in the art for a more convenient and automatic way to pierce the end of the cigar.

It is therefore an objective of the present invention to overcome the problems of the prior art noted above and provide an automatic cigar piercing device which operates in a simple and economical way.

It is another object of the present invention to provide a cigar piercing device which effectively and safely pierces the end of the cigar with a simple motion using in one hand.

It is yet another object of the present invention to provide a cigar piercing apparatus which accurately and efficiently positions and pierces the end of the cigar with minimal motion and effort on the part of the user.

SUMMARY OF THE INVENTION

The present invention is directed to a cigar piercing device which is positioned in a substantially vertical plane, and which allows a cigar to be pierced accurately through the downward motion of a cigar maintained in a substantially vertical plane. The device is automatic, and in one embodiment comprises a cylindrical housing which contains a recessed plate or thimble which receives the tip of the cigar which is registered against a hole contained in the center of the recessed plate. The recessed plate is movable from an upper position to a lower position which is controlled by a spring. The end of the cigar is positioned directly over the hole and pressed vertically downward which compresses the spring, and in its downward direction the cigar comes in contact with a rotating cutting head which is driven by a motor and bores a hole into the end of the cigar. This action takes place as pressure on the cigar overcomes the spring in its downward direction. A switch which is activated by the downward motion of the cigar completes an electrical circuit which causes the motor to start which activates a cutter blade drive shaft which contains the cutting head. The device can be easily operated with one hand.

Indexing means or indicia are contained on the outer surface of the housing of the device which allow for the device to be registered in a child safe position in which the electrical circuit has been shunted when not in use. Thus, the present invention provides for an economical and convenient device for piercing the end of the cigar, and further includes means to inactivate the device when not in use in order to prevent possible injury to a child.

BRIEF DESCRIPTION OF THE DRAWING

For a fuller understanding of the nature and objects of the invention, reference should be made to the following detailed description of a preferred mode of practicing the invention, read in connection with the accompanying drawings, in which.

DETAILED DESCRIPTION OF THE INVENTION

Figure 1:
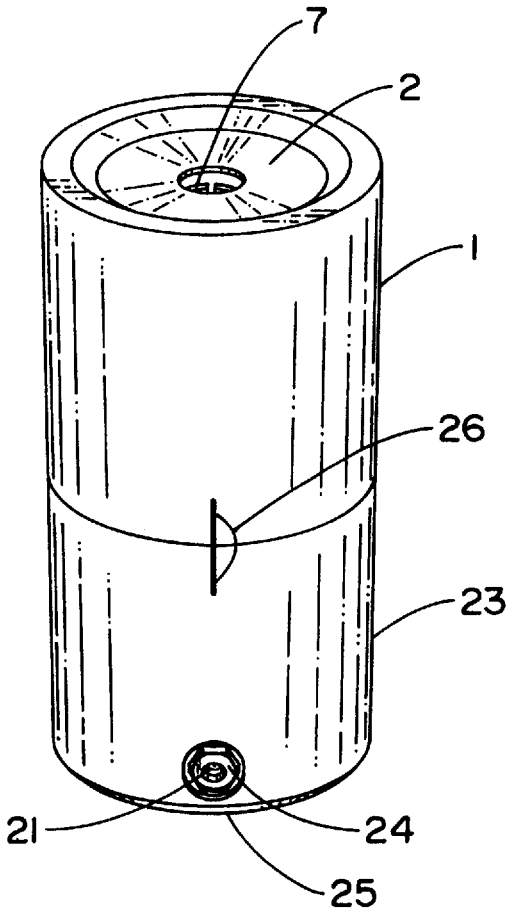
FIG. 1 is s perspective view of the device of the present invention

In the drawings, FIG. 1 presents a perspective view of the cigar piercing device of the present invention. The device comprises an upper cylindrical housing 1 which is telescoped in a pressed fit over a lower housing 23 having a stop or abutting shoulder 23*a*, more clearly shown in FIG. 2.

Figure 2:
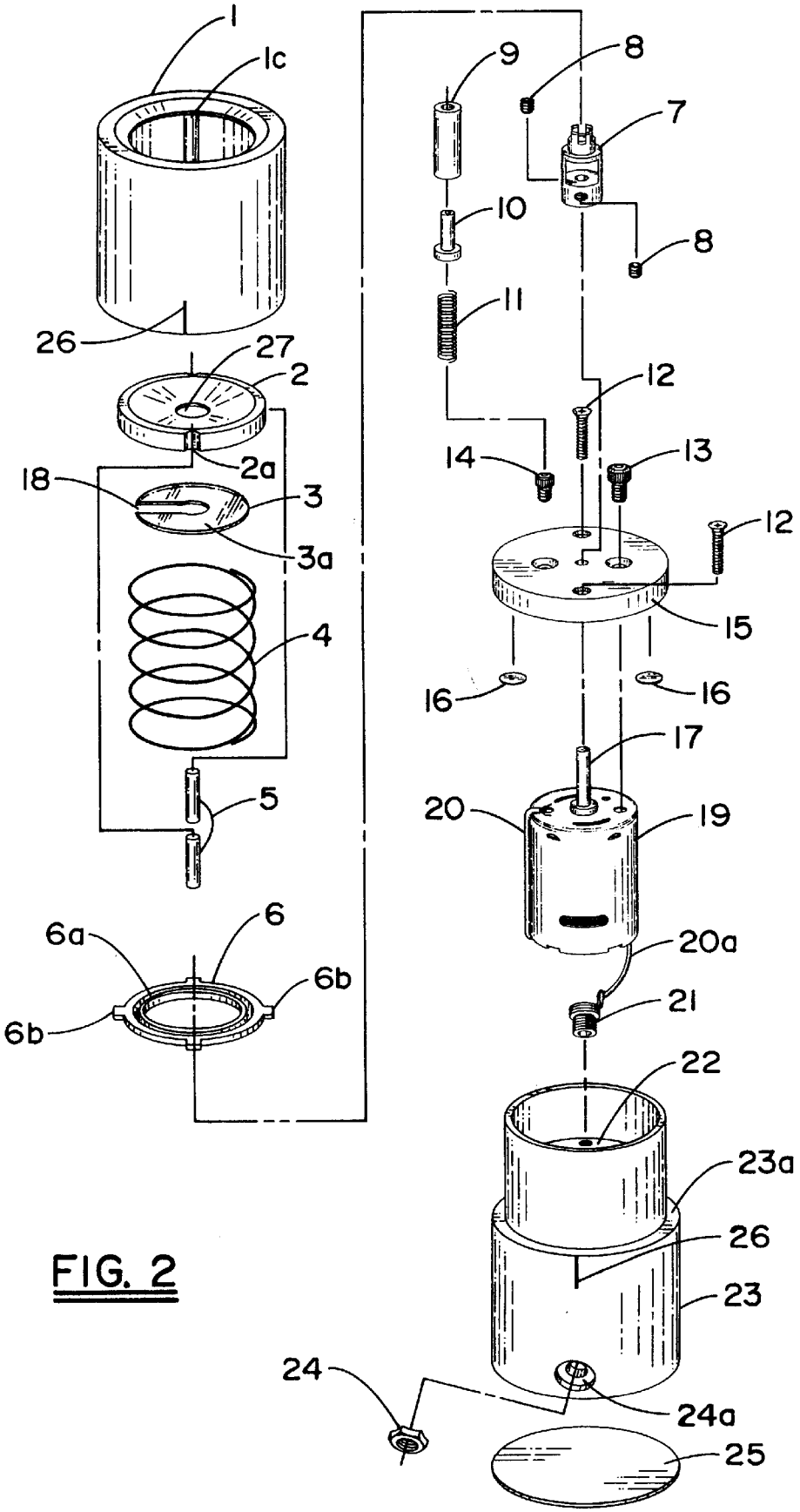
FIG. 2 is an exploded isomeric view of the device of the present invention.

FIG. 2 is an exploded isomeric view of the device of FIG. 1 in which the upper cylindrical housing 1 contains a cigar receiving thimble in the form of a recessed compression plate 2 which functions as an indexing station and which contains cutting head access hole 27 in the center of the plate to receive cutting head 7 which is contained at the end of a stationary cutter blade drive shaft 17 (see FIG. 2).

The lower housing is capped at its bottom surface by bottom plate 25 and contains an external female electrical connector 21 which is held in place by a retainer nut 24 in recess 24*a*.

Figure 3:
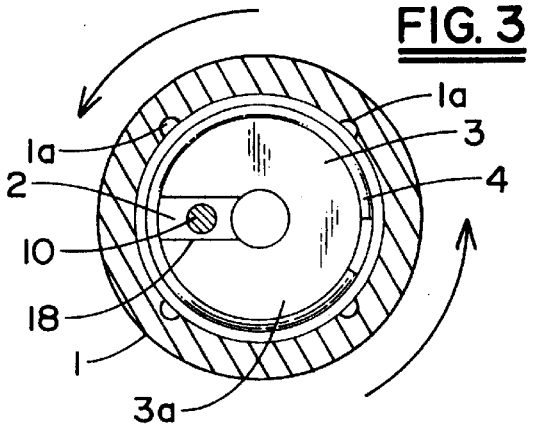
FIG. 3 is a sectional view of FIG. 5 showing the starter means for the electrical circuitry in the on position.
Figure 4:
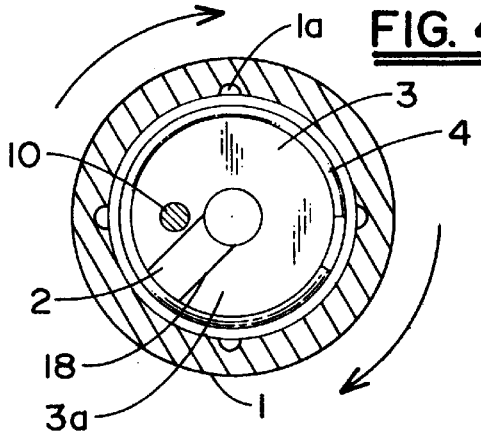
FIG. 4 is a sectional view of FIG. 6 showing the starter means in direct contact with means for the safe or off position of the device.

As shown in more detail in FIG. 2, upper housing 1 contains a compression plate 2 which contains a central hole 27 adapted to receive a contact disk 3 which is a nonconductive material, such as an electrically insulating tape or Mylar, which contains a slot 18. A compression spring 4 is connected in fixed engagement to compression plate 2 and to spring retainer 6 and provides mechanical resistance against compression plate 2 in its downward movement. Spring retainer 6 contains a top recessed circumferential groove 6*a* which holds the lower end of spring 4 in place. The spring 6 retainer further contains four locking tabs 6*b* which are received in recesses 1*a* (FIGS. 3 and 4) of circumferential groove 1*b* (FIG. 6) contained in upper housing 1. With spring 4 in position, retainer 6 is inserted into groove 1*b* (FIG. 6) by aligning tabs 6*b* with recesses 1*a* (FIG. 3). The retainer is forced against spring 4 and when in horizontal alignment with groove 1*b*, retainer 6 is rotated horizontally to force the tabs in recess 1*a* out of alignment with the recesses and locking the retainer 6 and spring 4 in place. Locking pins 5, hold compression plate 2 in position in upper housing 1 through slot 2*a* contained in compression plate 2 and groove 1*c* in upper housing 1.

Lower housing 23 is designed to contain the remaining components of the device which are illustrated in the right hand portion of FIG. 2. Any conventional DC motor may be used with the present invention. Suitable motors typically operate in a range of about 6–15 volts. The device illustrated in FIGS. 1–7 uses a 12 volt DC adaptor which can be plugged into any conventional outlet. An electrical motor 19 includes a wire lead 20*a* that electrically connects the motor armature first contact to a DC adaptor output lead through electrical connector 21. The lower/upper housing of the cigar piercing device is electrically connected to a DC adapter lead of opposite polarity. A mounting screw 14 electrically connects to the motor armature second contact through wire 20. Mounting screw 14 is in electrical communication with lower compression spring 11, internal sleeve pin 10, and starter pin housing 9. Thus, when plate 2 is depressed in that the spring/pin combination electrically passes through slot 18, the motor circuit is completed. The motor is mounted within the cylindrical cavity 22 in lower housing 23. The cylindrical cavity 22 also functions to hold the cigar shavings from the piercing operation. Cutter blade drive shaft 17 is attached to the armature shaft (not shown) of the motor 19 and contains a cutter head 7 which under high speed rotation cuts a clean efficient hole through the end of a cigar. Motor mounting plate 15 positions and holds the motor and the cutter blade drive shaft 17 within lower housing 23 through mounting screws 12, 13 and 14. Plastic shims or spacers 16 aid in alignment of the motor with the cutting head. The starter pin housing 9 contains an internal starter pin 10 and a lower compression spring 11 which is press fitted in place on motor mounting plate 15 (see FIG. 5). Indicia in the form of indicator marks 26 (FIG. 7) are contained on the outer surface of both the upper and lower housing for placing the device in the electrical operative or on position. This position is illustrated more clearly in FIGS. 3 and 4 of the drawings.

Figure 5:
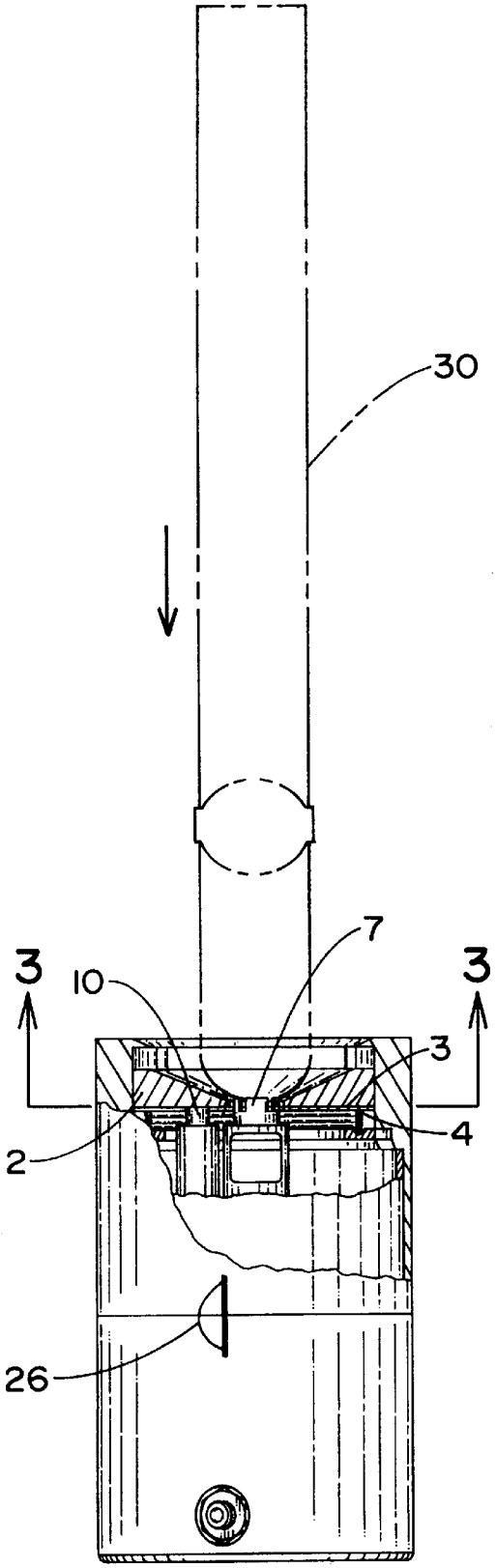
FIG. 5 is a cut away side view of the device in the on position.
Figure 6:
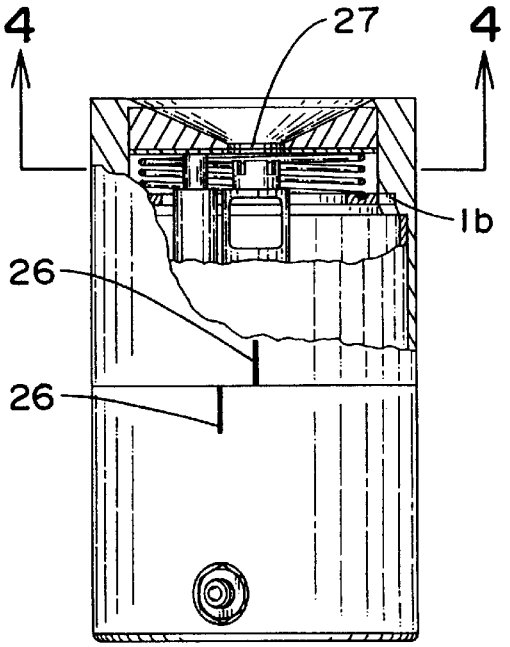
FIG. 6 is a view of FIG. 5 with the device in the off position.

In FIGS. 3 and 5 starter pin 10 is shown in direct contact with the base of the metal compression plate 2 as shown by slot 18 which because of the metal to metal contact completes an electrical circuit which causes motor 19 to start and rotate cutter shaft 17. When the upper and lower housing are rotated with respect to each other to place marks 26 out of alignment as illustrated in FIG. 6, the device is in the off position and will not operate electrically. This feature is more clearly shown in FIG. 4 which is a sectional view of FIG. 6. In this view, starter pin 10 is now in direct contact with an electrically insulating Mylar surface and breaks the electrical circuit. In this mode, the device is in the inoperative position.

In the on or operative position shown in FIG. 3, and FIG. 5, which is a cut-away side view of the device showing the cigar in the push down position, plate 2 is depressed and in turn allows starter pin 10 to depress and actuate motor 19. For the cutter to operate in response to the operation of the motor, the indicator marks 26 must therefore be in alignment as described above. Furthermore, as shown in FIGS. 5 and 6, where the device is in the off position, the indicator marks have not been aligned, and therefore even if plate 2 is depressed, completion of the electrical circuit cannot be made, and therefore the motor will not start.

Figure 7:
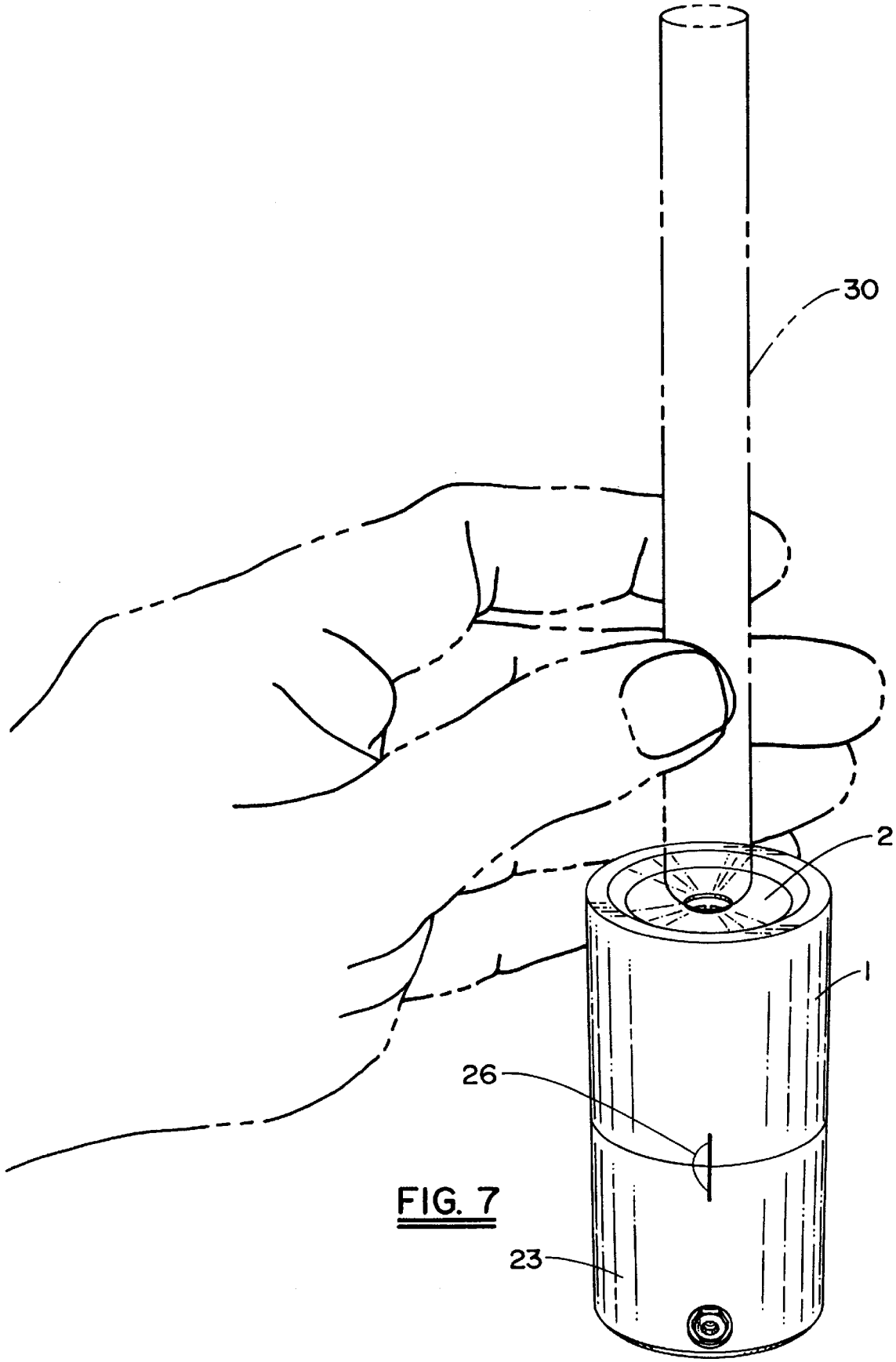
FIG. 7 is a perspective view of the device with a cigar positioned for piercing.

FIG. 7 is a perspective view which depicts operation of the device with one hand where a cigar 30 is placed with the uncut end over the cutting head access hole 27 with indicator marks 26 in proper alignment in order to complete the circuit when the depression plate 22 is pushed in the downward direction to depress starter pin 10 as described above.

Figure 8:
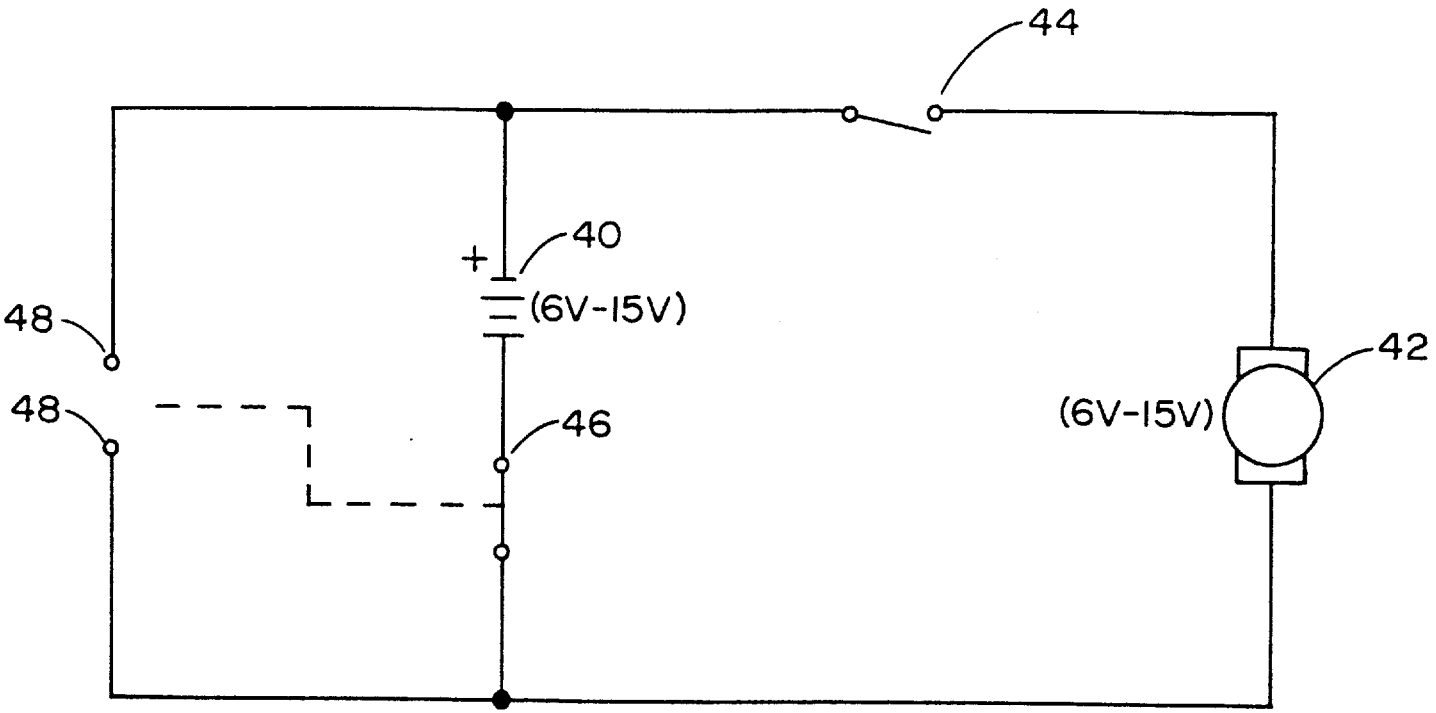
FIG. 8 is a schematic diagram of a battery powered circuit embodiment of the present invention.

Alternatively, the device of the present invention may be operated by battery rather than conventional outlet power, as illustrated in the schematic diagram FIG. 8. Referring to FIG. 8, the battery 40 is sized according to the electrical requirements of motor 42. The switch 44 comprises the electrical continuity of the starter pin 10 and slot 18, closing by the downward motion of a cigar, as described with reference to FIGS. 3, 4, and 5. The switch 44 is an N.O. (normally open) state switch. The switch 46 conventionally opens when an outlet power is connected to the piercing device circuit, or the prong(s) of an outlet source 48 are mechanically connected to the piercing device, preferentially an opening caused by the mechanical pressure of an outlet plug (not shown). The switch 46 is an N.C. (normally closed) state switch. In the closed position, without an outside power source, the switch 46 is closed and the battery 40 provides an operating voltage to the motor 42.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A cigar piercing device which includes an outer housing and a moveable top receiving and indexing station for positioning the tip of a cigar, said indexing station is adapted to automatically activate a rotating piercing tool in response to the downward movement of the indexing station by downward pressure being placed against the station by the tip of the cigar.

2. A cigar piercing device which comprises an outer housing which supports moveable top receiving and indexing station for positioning the tip of a cigar, said indexing station being adapted to automatically activate a motor driven rotating piercing tool in response to the downward movement of the indexing station by downward pressure being placed against the station by the tip of the cigar.

3. The device of claim 2 in which the indexing station comprises a concave plate which contains a central hole which receives the piercing tool at a predetermined distance during the downward movement of said indexing station.

4. A cigar piercing device which comprises:

(a) an outer housing which contains a moveable top receiving and indexing station for positioning the tip of a cigar, said indexing station being adapted to automatically activate a motor driven rotating piercing tool in response to the downward movement of the indexing station by downward pressure being placed against the station by the tip of the cigar, (b) a motor electrically connected to rotate said piercing tool; and (c) means contained on said indexing station to complete an electrical circuit to activate said motor in response to said downward movement of said indexing station.

5. The device of claim 4 in which the downward movement of said indexing station is controlled on a spring.

6. The device of claim 4 in which means are provided to shunt the electrical circuit and place the device in an inactivated or off position.

* * * * *